US007662037B2

(12) United States Patent
Polston

(10) Patent No.: US 7,662,037 B2
(45) Date of Patent: Feb. 16, 2010

(54) ROOF RIDGE VENT

(75) Inventor: Scott R. Polston, Houston, TX (US)

(73) Assignee: Ross Manufacturing, LLC, New Braunfels, TX (US)

( * ) Notice: Subject to any disclaimer, the term of this patent is extended or adjusted under 35 U.S.C. 154(b) by 104 days.

(21) Appl. No.: 11/895,380

(22) Filed: Aug. 24, 2007

(65) Prior Publication Data

US 2008/0064320 A1 Mar. 13, 2008

Related U.S. Application Data

(60) Provisional application No. 60/824,834, filed on Sep. 7, 2006.

(51) Int. Cl.
*F24F 7/02* (2006.01)
*E04B 7/00* (2006.01)

(52) U.S. Cl. ..... 454/365; 52/198; 52/199

(58) Field of Classification Search ..... 454/364, 454/365, 366; 52/198, 199
See application file for complete search history.

(56) References Cited

U.S. PATENT DOCUMENTS

| | | | | | |
|---|---|---|---|---|---|
| 4,803,813 | A * | 2/1989 | Fiterman | 52/199 |
| 5,331,783 | A * | 7/1994 | Kasner et al. | 52/199 |
| 5,535,558 | A * | 7/1996 | Rieke et al. | 52/199 |
| 5,600,928 | A * | 2/1997 | Hess et al. | 52/309.4 |
| 5,651,734 | A * | 7/1997 | Morris | 454/365 |
| 6,128,869 | A * | 10/2000 | Brotherton et al. | 52/198 |
| 6,227,963 | B1 * | 5/2001 | Headrick | 454/365 |
| 6,277,024 | B1 * | 8/2001 | Coulton | 454/365 |
| 6,981,916 | B2 * | 1/2006 | Coulton | 454/365 |
| 2004/0088928 | A1 * | 5/2004 | Headrick et al. | 52/98 |

* cited by examiner

*Primary Examiner*—Steven B McAllister
*Assistant Examiner*—Patrick F. O'Reilly, III
(74) *Attorney, Agent, or Firm*—Jack A. Kanz

(57) ABSTRACT

A roof ridge vent is formed with separation lines parallel with its outer edges which permit separation of the outer edge portions of the structure. In its original configuration, the roof vent structure may be used with wide cap shingles. Removal of the outer edge portions permits the ridge vent to be used in connection with narrower cap shingles.

10 Claims, 5 Drawing Sheets

ROOF RIDGE VENT

This invention relates to vents for air circulation in the attic space between roof and ceiling in building structures. More particularly, it relates to roof ridge vent structures which may be modified on site to accommodate various sizes of standard roof cap shingles.

Venting arrangements have long been used to permit ventilation of the attic space between ceiling and roof in conventional pitched roof constructions. Roof ridge vents are typically devices which bridge the open ridge or peak of a roof and permit air to enter and escape the attic space through openings in the lateral edges of the ridge vent device. Typically, ridge vent structures are in the form of injection-molded elongated sections of high density polyethylene which may include self-sealing and joining elements to couple the sections together as the vent sections are installed. Conventional ridge vent structures are disclosed U.S. Pat. No. 6,277,024 and U.S. Pat. No. 6,981,916.

During installation of sectional roof ridge vents, individual roof ridge vent sections are attached end-to-end and secured on the roof ridge so that the lateral edges of the ridge vent overlap the upper edge of the top row of shingles, thereby bridging the peak of the roof. Cap shingles are then applied to the top surface of the ridge vent structure to complete the roof.

Conventionally, cap shingles are either nine (9) inches or twelve (12) inches wide. The narrower cap shingles are often preferred and are usually more expensive because they are commonly made thicker with more material available for erosion by weather. The wider cap shingles are sometimes preferred for other reasons. Since the width of the ridge vent is determined by the width of the cap shingle to be used, a narrow cap shingle cannot be used with a wide vent or vice versa. Since the needs or desires of the builder or customer may require either a narrow or wide cap shingle, manufacturers make and suppliers usually maintain an inventory of both wide and narrow vent structures. Such duplicate inventories, etc., unnecessarily increase costs of manufacturing, shipping, distribution, storing and the like. It would, therefore, be economically advantageous and construction greatly simplified if duplication of ridge vent structures could be eliminated and a single structure used for both narrow and wide vent structure needs.

In accordance with the present invention, a ridge vent structure is provided which may be used with either wide or narrow cap shingles. The vent structure is manufactured in a size and geometry which accepts and can be conveniently used with wide cap shingles. The structure of the invention, however, is arranged to be readily and easily modified at the jobsite to accept and be used in connection with narrow cap shingles. Since the invention provides a single ridge vent structure which may be used with either wide or narrow cap shingles, the necessity of producing, shipping, storage, etc., two types of vent structures is totally eliminated. Not only is the cost of duplicating and distribution of duplicate structures eliminated, inventory maintenance is simplified and the inefficiencies and time consumed by accidental delivery to the jobsite of the wrong size of ridge vent is totally avoided.

Other features and advantages of the invention will become more readily understood from the following detailed description taken in connection with the appended claims and attached drawing in which:

The attached drawing is incorporated into and forms part of the specification to illustrate exemplary embodiments of the invention. For clarity of illustration, like reference numerals designate corresponding elements throughout the drawing.

It will be recognized that the principles of the invention may be utilized and embodied in many and various forms, and it should be recognized that various materials may be used in fabricating the structures of the invention. In order to demonstrate these principles, the invention is described herein by reference to specific preferred embodiments. The invention, however, is not limited to the specific forms illustrated and described.

Figure 1:
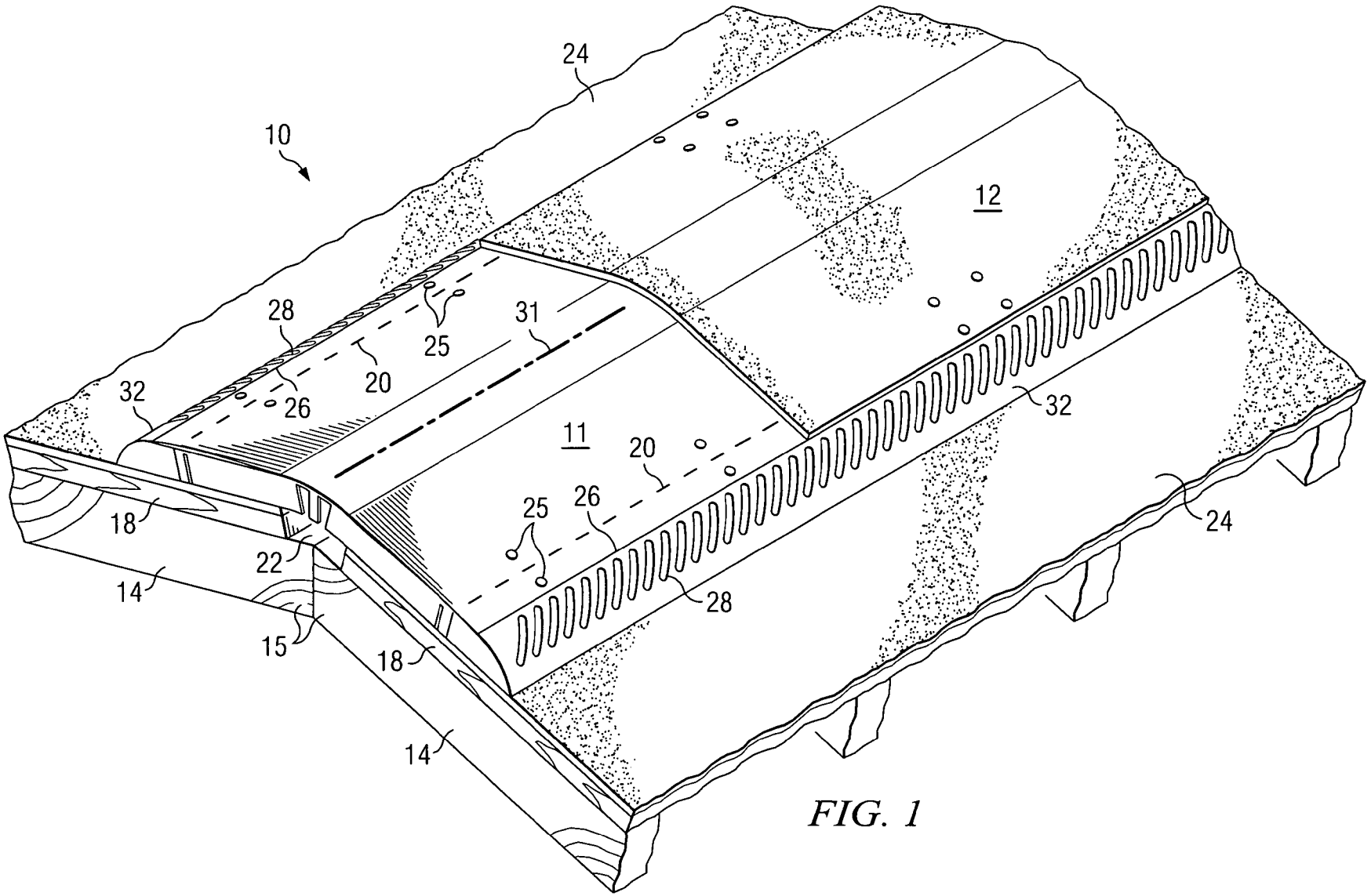
FIG. 1 is a perspective view, partially in section and partially broken away, of a roof construction employing a preferred embodiment of the ridge vent structure of the invention.
Figure 2:
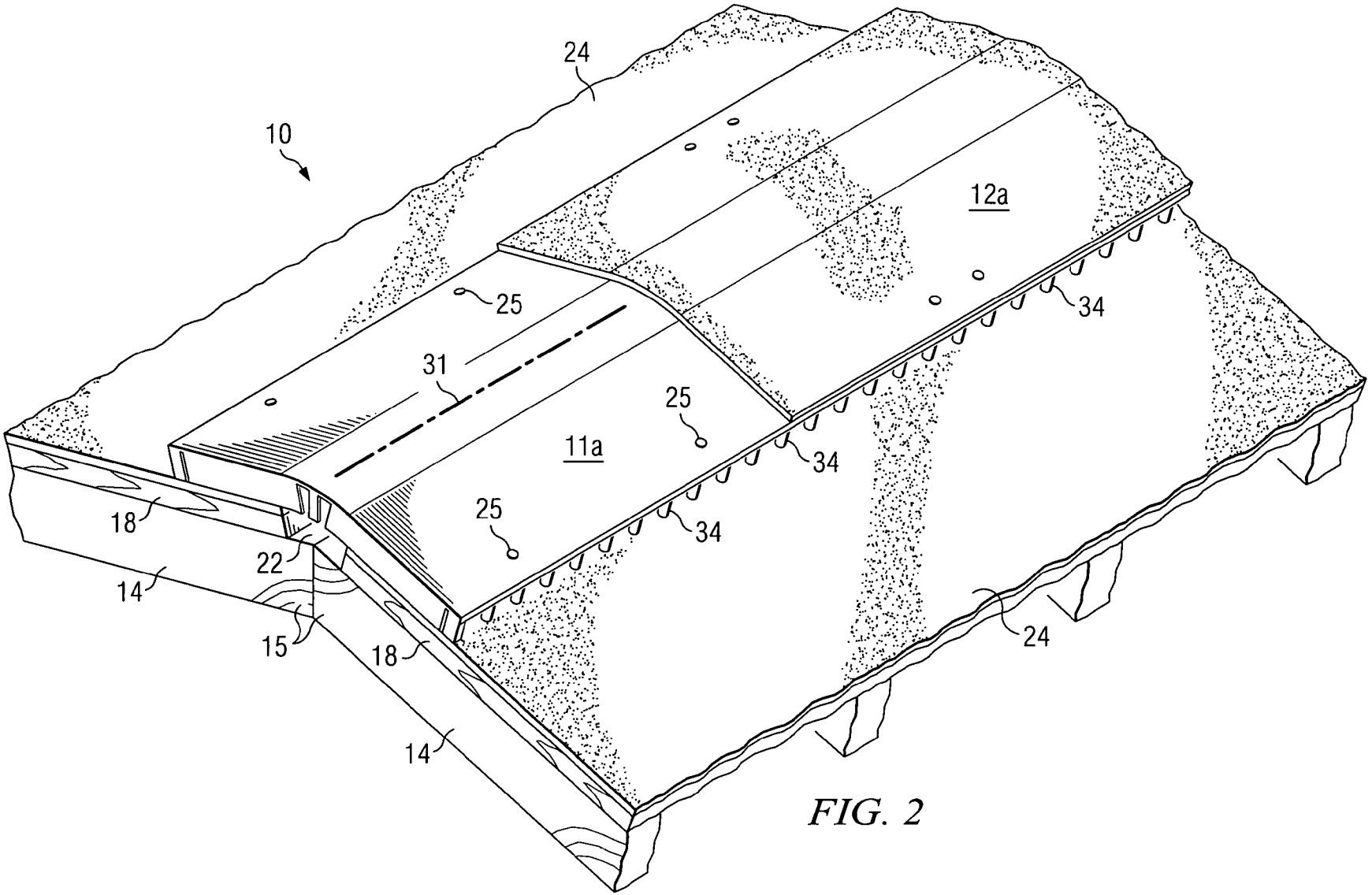
FIG. 2 is a perspective view, partially in section and partially broken away, of a roof construction employing a preferred embodiment of the ridge vent structure of the invention modified to permit use as a narrower vent structure.

A typical roof construction employing a preferred embodiment of the ridge vent structure of the invention is illustrated in FIGS. 1 and 2. A typical roof 10 is formed by a plurality of inclined rafters 14 supported at their lower ends by walls (not shown) or other structure. The rafters 14 are employed in pairs with their upper opposed ends 15 joined directly or with a ridge beam (not shown) or the like to form the apex of a pitched roof 10. A roof deck 18, typically of plywood or other suitable material, is secured to the rafters 14 to provide the structural base of the roof. The deck 18 is typically covered with overlapping shingles 24. A vent 22 is cut into or otherwise formed at the apex of the roof deck 18. The vent 22 is then bridged with a ridge vent structure 11, 11*a* as shown in FIGS. 1 and 2. Cap shingles 12, 12*a* are then secured to the top surface of the ridge vent structure 11, 11*a* to complete the roof.

As construction standards have developed, the dimensions of cap shingles (and thus ridge vent structures) have become standardized. Currently, standardized cap shingles are manufactured in either nine (9) inch or twelve (12) inch widths. The width of cap shingles to be used determines the width of the ridge vent structure to be used. The roof ridge vent structure of the invention is provided in the standard wider width but readily modified at the jobsite to the narrower standard size.

In the preferred embodiment illustrated, the vent structure comprises an elongated ridge vent body structure 11 which defines a longitudinal centerline (identified by dashed line 31 in FIGS. 1, 2 and 3) with parallel side edges 32. The top surface is substantially smooth and adapted to be covered by cap shingles 12, 12*a*. A plurality of vanes 33, pins or pegs 34 and/or baffles 35 extend a uniform distance from the bottom surface which, when positioned on the surface of the top shingle 24, define ventilation passageways extending between the outside of the roof and vent 22.

Figure 6:
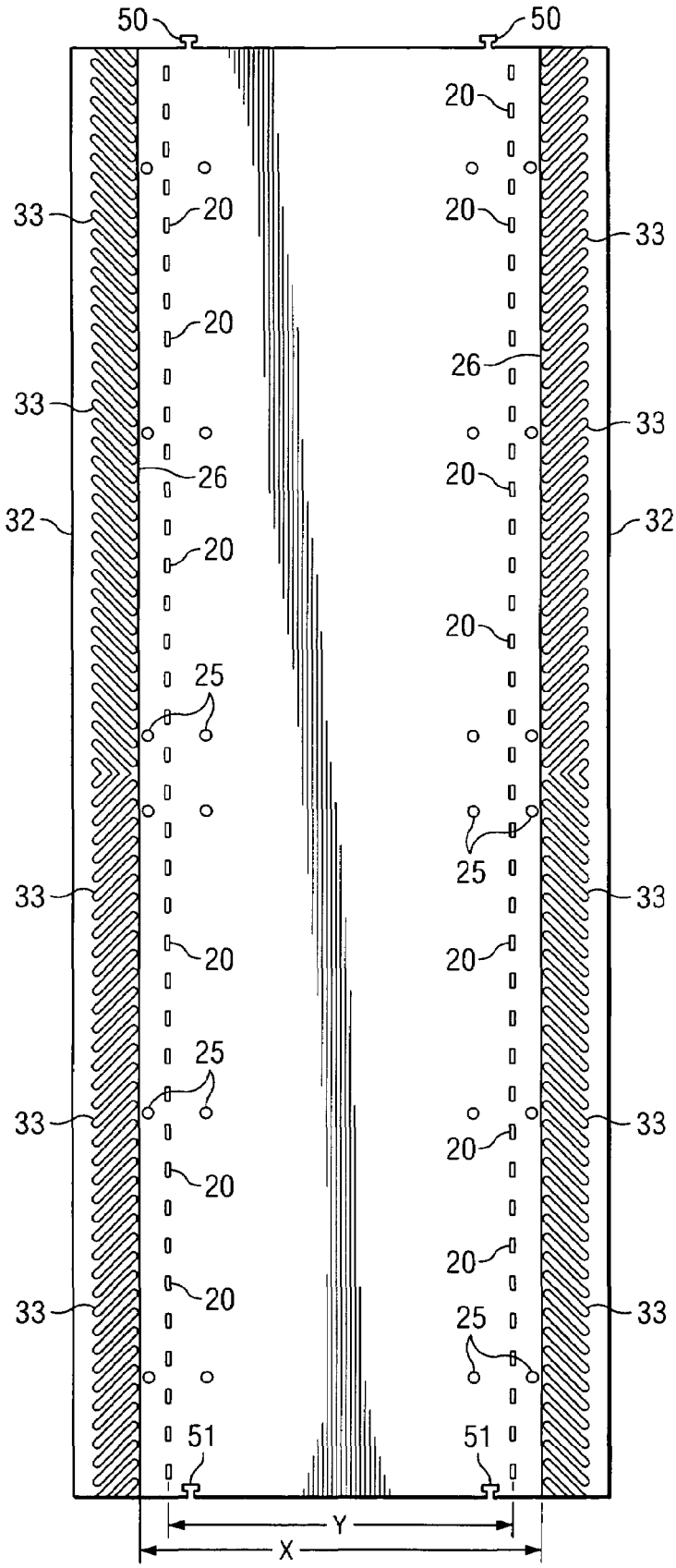
FIG. 6 is a top plan view of the roof ridge vent structure of FIG. 1.
Figure 7:
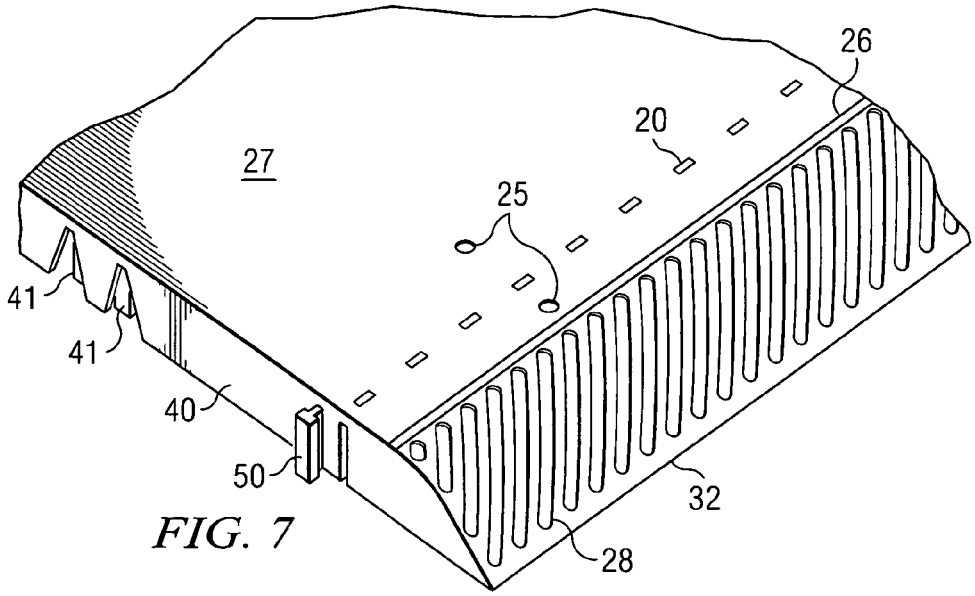
FIG. 7 is a fragmentary perspective view of a portion of the top side of the ridge vent structure of FIG. 1.

As illustrated in FIGS. 1, 6 and 7, the outer edge 26 of the top surface 27 terminates in a series of slots 28 which define a downwardly sloping grillwork. The slots 28 thus define the outer inlet/outlet of vent passageways through the ridge vent structure.

In the embodiment illustrated, a series of vanes 33 depends from the bottom surface of the vent structure 11. These vanes 33 are aligned in rows parallel with each side edge 32 and, when placed adjacent the top shingle 24, cooperate with slots 28 to form the outer inlet/outlet of the vent passageways. To accommodate conventional twelve (12) inch cap shingles 12, the width of the top surface 27 (between outer edges 26) is twelve (12) inches.

A separation line 20 is formed parallel with and spaced from each outer edge 26. The separation line 20 may be a groove, a score line, a series of holes or any other suitable device or weakened portion of the body 11 which permits or promotes easy separation of the outer edge portions of the body 11 to define a body 11*a* of narrower width. Where the ridge vent body is molded plastic or the like, the separation line 20 may be a score line along which the edge portions may be separated by merely flexing the edge portions. Alternatively, the separation line 20 may be a groove or the like which is used to align a suitable cutting tool to remove the outer edges. When the outer edges are removed, the width of the top surface 27 (between separation lines 20) is reduced to nine (9) inches.

Figure 3:
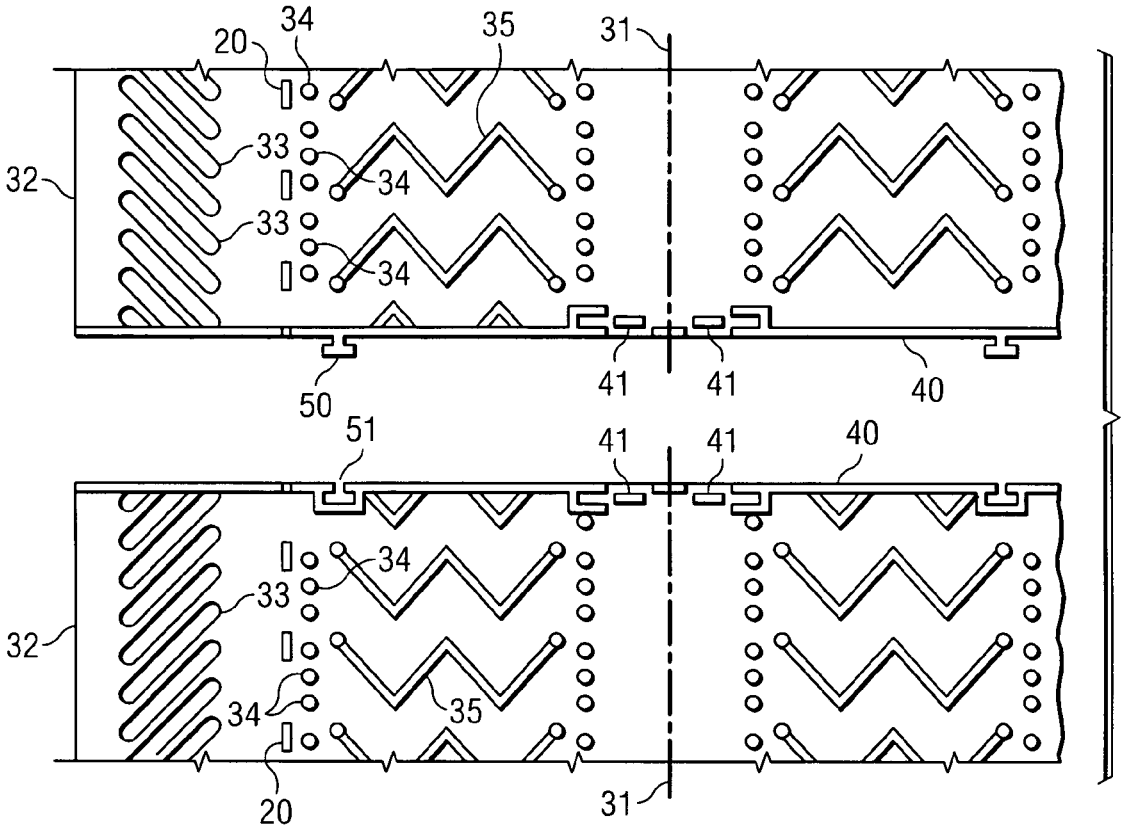
FIG. 3 is a bottom plan view, partially broken away, of opposite mating ends of the ridge vent structure of FIG. 1.

As illustrated in FIG. 3, the vanes 33 are supported outboard from separation lines 20. A series of pins or pegs 34 depends from the bottom of ridge vent body 11*a* immediately inboard from each separation line 20. The pins 34 are spaced to provide a grillwork which permits passage of air but inhibits ingress of insects, etc., through the ridge vent structure. As shown in more detail in FIG. 8, baffles 35 (along with pins 34) depending from the bottom surface of the ridge vent body 11*a* cooperate with the top shingle 24 to define air passageways through the ridge vent structure.

As illustrated in FIGS. 1 and 2, a row of nail holes 25 (or other means for securing the structure to the roof) is aligned along each side of each separation line 20. Where the ridge vent structure is used in its wider configuration, the body 11 is secured to the roof with nails passing through the outer rows of nail holes 25. Where the ridge vent structure is used in its narrower configuration, the body 11*a* is secured to the roof with nails passing through the inboard rows of nail holes 25.

It will be appreciated that the adjustable width ridge vent structure described above may be manufactured in any desired dimensions and made using various suitable materials. Current standard widths of cap shingles are nine (9) inches and twelve (12) inches. Thus the width of the top surface of the ridge vent structure of the invention (noted as dimension "x" in FIG. 6) is twelve (12) inches and the width of the top surface of the modified structure is nine (9) inches (noted as dimension "y" in FIG. 6). These dimensions, however, may be changed as required to accommodate other shingle widths and construction standards without departing from the principles of the invention.

The ridge vent structure of the invention may be formed in a continuous length of material and simply cut to length at the jobsite. Alternatively, the structure may be made in sections of suitable length. When the roof vent structure is formed in sections, end walls which enclose the open ends of the structure are preferably integrally formed on each section. However, since the roof vent structure must accommodate pitched roofs, the vent structure must be somewhat flexible to adapt to various roof pitch angles. Obviously, the end walls must also be adaptable to various pitch angles.

Figure 4:
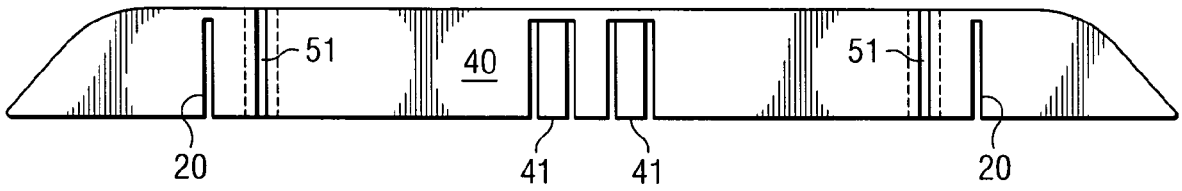
FIG. 4 is an end view of the roof ridge vent structure of FIG. 1 in the pre-use condition.
Figure 5:
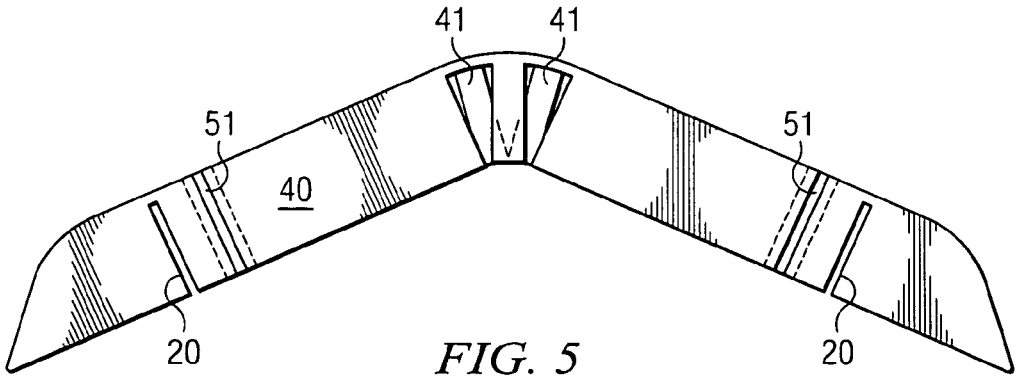
FIG. 5 is an end view of the roof ridge vent structure of FIG. 1 as applied to a pitched roof to form a roof ridge vent.

In the embodiment illustrated, an end wall 40 is formed adjacent each end of the vent structure body 11. The height of wall 40 is substantially the same as the height of pins 34, vanes 33 and baffles 35 and thus encloses the ends of the vent structure to restrict air flow to lateral movement only through the inlets/outlets at the edges of the vent structure. As illustrated in FIGS. 4 and 5, separation line 20 extends through end wall 40 to allow easy separation of the outer edge portions as described above.

Figure 8:
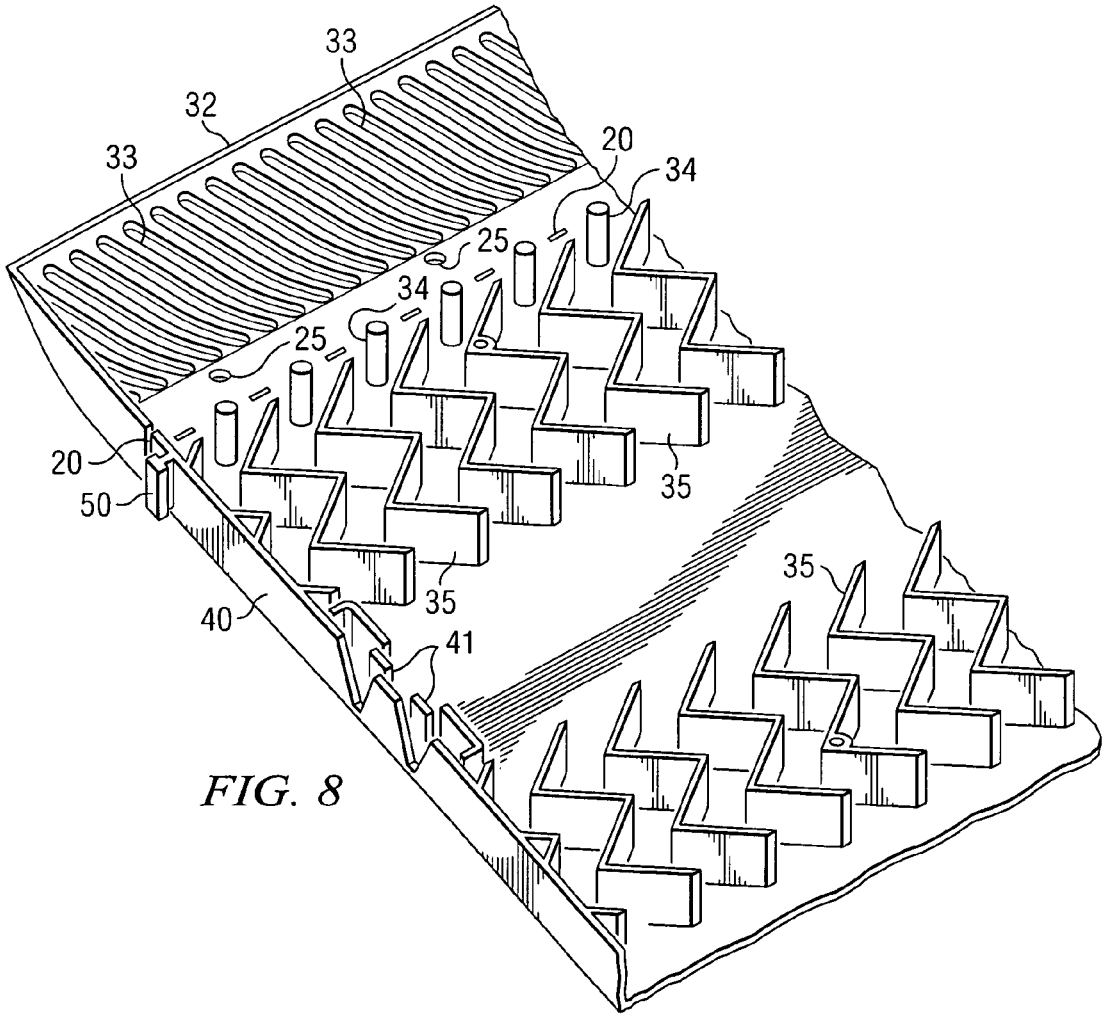
FIG. 8 is a fragmentary perspective view of a portion of the underside of the ridge vent structure of FIG. 1.

In order to allow the structure 11 to flex along centerline 31, the end wall is separated into offset sections 41 on each side of the centerline 31 (see FIGS. 3, 5 and 8). As shown in FIGS. 4 and 5, the offset sections 41 depend from the bottom surface of the vent body 11 and are aligned with corresponding gaps in end wall 40. Thus, as the vent body 11 is flexed along centerline 31 to bridge the apex of a pitched roof, the sections 41 act as shutters closing the gaps in the end wall 40 without inhibiting flexing of the vent body 11.

The ends walls 40 may also provide means for interconnecting adjacent sections of ridge vent sections. As illustrated in FIGS. 3 and 8, one end wall 40 is provided with a pair of tongues 50 which mate with matching grooves 51 on the opposite end wall 40 of each section. When assembling a series of sections, the tongues are inserted into the grooves 51 to interconnect a plurality of sections and form a roof ridge vent of the desired length.

It will be appreciated that the invention is not limited to any particular dimensions or materials. Various materials of construction will be found suitable by those skilled in the art and the arrangement of vents, vanes, etc., may be varied as desired.

While only exemplary embodiments of the invention have been illustrated and described in detail herein, it will be readily recognized that the principles of the invention may be used in various forms to provide roof ridge vent structures which may be used as manufactured or readily modified as required to provide wide or narrow ridge vent structures. It is to be understood, therefore, that even though numerous characteristics and advantages of the invention have been set forth in detail herein, the foregoing description, together with details of the structure and function of the various embodiments, is to be considered illustrative only. Various changes and modifications may be made in detail, especially in matters of shape, size and materials as well as arrangement and combination of parts, without departing from the spirit and scope of the invention as defined by the appended claims.

What is claimed:

1. An adjustable-pitch roof ridge vent comprising:

(a) an elongated body defining a longitudinal centerline and having a bottom surface, a substantially smooth top surface and side edges parallel with said centerline;

(b) ventilation passageways formed under said bottom surface and extending laterally toward said side edges;

(c) a separation line which permits easy separation of an outer edge portion of said elongated body extending parallel with each of said side edges defining a severable outer edge portion; and (d) holes positioned on opposite sides of each separation line to accommodate means for securing said elongated body to bridge the apex of a pitched roof;

wherein the holes positioned on opposite sides of each separation line comprise a first plurality of holes disposed inwardly from each separation line for receiving attachment means when the outer edge portion is severed from the elongated body of the roof ridge vent in an installed condition, and a second plurality of holes disposed outwardly from each separation line for receiving attachment means when the outer edge portion remains attached to the elongated body of the roof ridge vent in an installed condition; and wherein the roof ridge vent has a first installed width when the outer edge portion remains attached to the elongated body of the roof ridge vent and the roof ridge vent has a second installed width when the outer edge portion is severed from the elongated body of the roof ridge vent, the first installed width being greater than the second installed width.

2. An adjustable-pitch roof vent as defined in claim 1 further comprising:

(e) end faces depending from opposite ends of said elongated body defining gaps and offset sections which permit said elongated body to flex along said centerline.

3. An adjustable-pitch roof vent as defined in claim 2 wherein the end face on one end of said body supports a tongue adapted to mate with a groove in the end face of an adjoining section of roof vent structure.

4. An adjustable-pitch roof vent as defined in claim 1 wherein said separation line comprises a score line in said elongated body.

5. An adjustable-pitch roof vent as defined in claim 1 wherein said separation line comprises a row of holes extending through said elongated body.

6. A roof ridge vent comprising:

(a) an elongated body defining a longitudinal centerline and having a bottom surface, a top surface and side edges parallel with said centerline;

(b) ventilation passageways formed under said bottom surface permitting air to flow laterally through said elongated body;

(c) a separation line which permits easy separation of an outer edge portion of said elongated body extending parallel with each of said side edges defining a severable outer edge portion; and (d) means on opposite sides of each separation line facilitating securing of said elongated body to bridge the apex of a pitched roof;

wherein at least part of said means facilitating securing is disposed inwardly from each separation line when the outer edge portion is severed from the elongated body of the roof ridge vent in an installed condition;

wherein at least part of said means facilitating securing is disposed outwardly from each separation line when the outer edge portion remains attached to the elongated body of the roof ridge vent in an installed condition; and wherein the roof ridge vent has a first installed width when the outer edge portion remains attached to the elongated body of the roof ridge vent and the roof ridge vent has a second installed width when the outer edge portion is severed from the elongated body of the roof ridge vent, the first installed width being greater than the second installed width.

7. A roof ridge vent as defined in claim 6 further comprising:

(e) end faces depending from opposite ends of said elongated body defining gaps and offset sections which permit said elongated body to flex along said centerline.

8. A roof ridge vent as defined in claim 7 wherein the end face on one end of said body supports a tongue adapted to mate with a groove in the end face of an adjoining section of roof vent structure.

9. A roof ridge vent as defined in claim 6 wherein said separation line comprises a score line in said elongated body.

10. A roof ridge vent as defined in claim 6 wherein said separation line comprises a weakened portion of said elongated body.

* * * * *